US010175592B2

(12) United States Patent
Yamashita

(10) Patent No.: US 10,175,592 B2
(45) Date of Patent: Jan. 8, 2019

(54) ELECTROSTATIC LATENT IMAGE DEVELOPING TONER, IMAGE FORMING APPARATUS, AND IMAGE FORMATION METHOD

(71) Applicant: KYOCERA Document Solutions Inc., Osaka (JP)

(72) Inventor: Masashi Yamashita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/874,943

(22) Filed: Jan. 19, 2018

(65) Prior Publication Data

US 2018/0217514 A1 Aug. 2, 2018

(30) Foreign Application Priority Data

Jan. 31, 2017 (JP) ..... 2017-015252

(51) Int. Cl.
*G03G 9/08* (2006.01)
*G03G 15/08* (2006.01)
*G03G 9/097* (2006.01)

(52) U.S. Cl.
CPC ..... *G03G 9/08* (2013.01); *G03G 9/0819* (2013.01); *G03G 9/09775* (2013.01); *G03G 15/08* (2013.01); *G03G 15/0808* (2013.01)

(58) Field of Classification Search
CPC ..... G03G 9/09775
USPC ..... 430/108.3
See application file for complete search history.

(56) References Cited

U.S. PATENT DOCUMENTS 6,677,096 B2 1/2004 Tachi et al.
2003/0022087 A1 1/2003 Tachi et al.

FOREIGN PATENT DOCUMENTS

JP 2003-302786 A 10/2003

*Primary Examiner* — Mark A Chapman
(74) *Attorney, Agent, or Firm* — Studebaker & Brackett PC

(57) ABSTRACT

A toner has positive chargeability. Particles of the toner each include a toner mother particle and external additive particles adhering to a surface of the toner mother particle. The external additive particles include first external additive particles and second external additive particles. The first external additive particles have positive chargeability and are each a first silica particle having a surface treated with a positive chargeability imparting agent and a hydrophobing agent. The second external additive particles have negative chargeability and are each a second silica particle having a surface treated only with a silane compound. The silane compound is at least one alkylalkoxysilane represented by formula (I) shown below. In formula (I), $R^1$ represents an alkyl group having a carbon number of at least 8 and no greater than 16. $R^2$, $R^3$, and $R^4$ each represent, independently of one another, an optionally substituted hydrocarbon group.

(1)

9 Claims, 6 Drawing Sheets

ELECTROSTATIC LATENT IMAGE DEVELOPING TONER, IMAGE FORMING APPARATUS, AND IMAGE FORMATION METHOD

INCORPORATION BY REFERENCE

The present application claims priority under 35 U.S.C. § 119 to Japanese Patent Application No. 2017-015252, filed on Jan. 31, 2017. The contents of this application are incorporated herein by reference in their entirety.

BACKGROUND

The present disclosure relates to electrostatic latent image developing toners, image forming apparatuses, and image formation methods.

Toner particles each including a toner mother particle and external additive particles adhering to a surface of the toner mother particle are known as toner particles included in an electrostatic latent image developing toner. In one example, a known toner is a positively chargeable toner for two-component development. In one example, external additive particles include positively chargeable silica particles and negatively chargeable silica particles.

SUMMARY

An electrostatic latent image developing toner according to an aspect of the present disclosure includes a plurality of toner particles. The electrostatic latent image developing toner has positive chargeability. The toner particles each include a toner mother particle and external additive particles adhering to a surface of the toner mother particle. The external additive particles include a plurality of first external additive particles and a plurality of second external additive particles. The first external additive particles have positive chargeability and are each a first silica particle having a surface treated with a positive chargeability imparting agent and a hydrophobing agent. The second external additive particles have negative chargeability and are each a second silica particle having a surface treated only with a silane compound. The silane compound is at least one alkylalkoxysilane represented by formula (1) shown below.

(1)

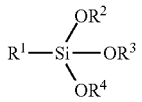

In formula (1), $R^1$ represents an alkyl group having a carbon number of at least 8 and no greater than 16. $R^2$, $R^3$, and $R^4$ each represent, independently of one another, an optionally substituted hydrocarbon group.

An image forming apparatus according to another aspect of the present disclosure forms an image using a developer. More specifically, the image forming apparatus according to the aspect of the present disclosure includes an image bearing member that bears an electrostatic latent image on a surface thereof and a development section that develops the electrostatic latent image into a toner image. The developer includes the electrostatic latent image developing toner having the above-described configuration and an electrostatic latent image developing carrier. The electrostatic latent image developing carrier positively charges the electrostatic latent image developing toner by friction. The development section includes a developer bearing member that bears the developer on a surface thereof, and a toner bearing member that receives the electrostatic latent image developing toner from the developer bearing member and bears the electrostatic latent image developing toner on a surface thereof. The developer bearing member and the toner bearing member rotate while the developer on the surface of the developer bearing member is in contact with the toner bearing member. The toner bearing member and the image bearing member are disposed such that the electrostatic latent image developing toner on the surface of the toner bearing member detaches therefrom and lands on the electrostatic latent image to develop the electrostatic latent image into the toner image.

An image formation method according to another aspect of the present disclosure is a method for forming an image using a developer. More specifically, the image formation method according to the aspect of the present disclosure includes: causing the developer to be carried on a surface of a developer bearing member, the developer including the electrostatic latent image developing toner having the above-described configuration and an electrostatic latent image developing carrier for positively charging the electrostatic latent image developing toner by friction; forming a toner layer including the electrostatic latent image developing toner on a surface of a toner bearing member located opposite to the developer bearing member; forming an electrostatic latent image on a surface of an image bearing member located opposite to the toner bearing member; and causing the electrostatic latent image developing toner to detach from the toner layer and land on the electrostatic latent image to develop the electrostatic latent image into a toner image. In the forming the toner layer on the surface of the toner bearing member, the electrostatic latent image developing toner is caused to move from the surface of the developer bearing member to the surface of the toner bearing member through the developer on the surface of the developer bearing member rubbing against the surface of the toner bearing member.

DETAILED DESCRIPTION

Figure 1:
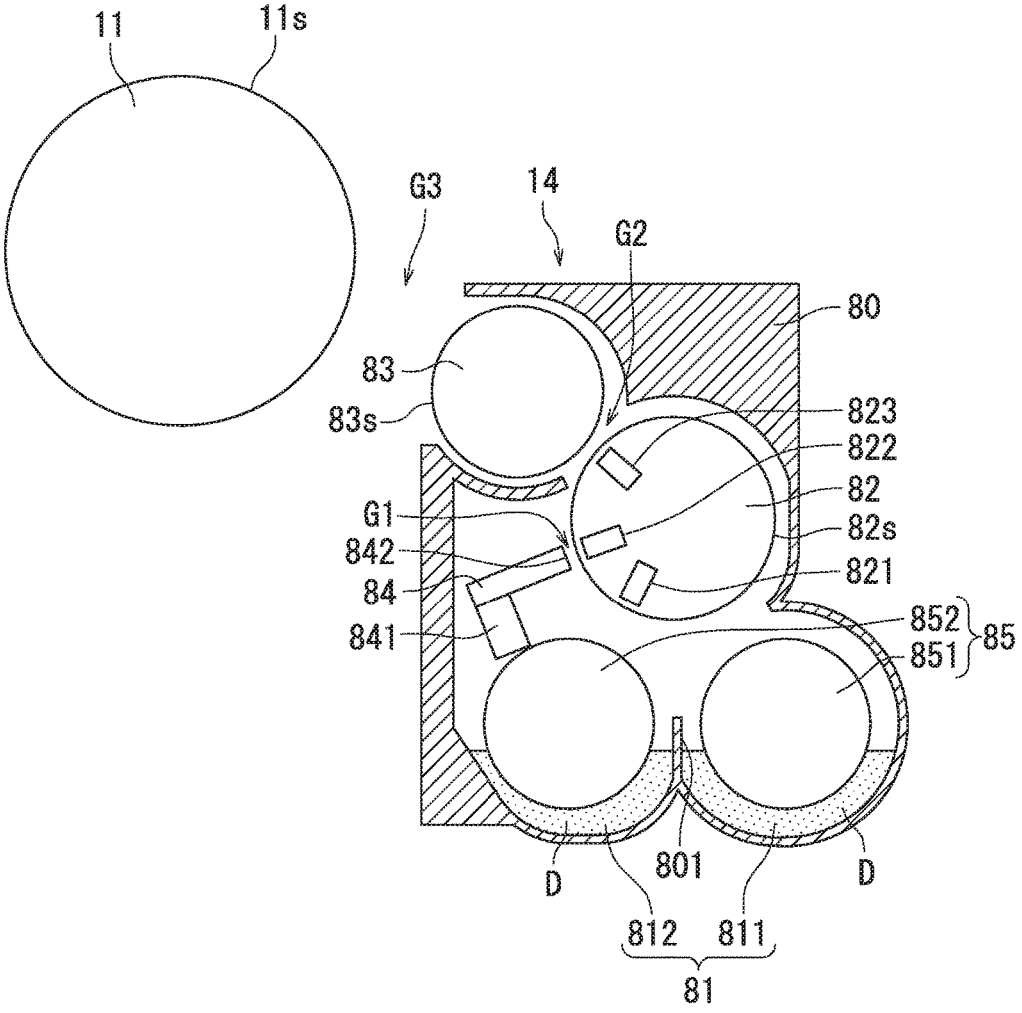
FIG. 1 is a diagram illustrating a configuration of main parts of an image forming apparatus adopting a touchdown developing method.

The following describes an embodiment of the present disclosure. Note that unless otherwise stated, results (for example, values indicating shapes or properties) of evaluations related to toner cores, toner particles, toner mother particles, first external additive particles, and second external additive particles shown below are each a number average of measurements made with respect to an appropriate number of particles.

A number average particle diameter of a powder is a number average of equivalent circle diameters of primary particles (diameters of circles having the same area as projections of the particles) measured using a microscope, unless otherwise stated. A value for volume median diameter ($D_{50}$) of a powder is measured based on the Coulter principle (electrical sensing zone technique) using "Coulter Counter Multisizer 3", product of Beckman Coulter, Inc., unless otherwise stated.

Chargeability refers to chargeability in triboelectric charging, unless otherwise stated. Strength of positive chargeability in triboelectric charging or strength of negative chargeability in triboelectric charging can be confirmed by a known triboelectric series.

The term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. The term "(meth)acryl" may be used as a generic term for both acryl and methacryl.

[Feature of Electrostatic Latent Image Developing Toner of Present Embodiment]

The electrostatic latent image developing toner (also referred to below as "toner") according to the present embodiment has positive chargeability. The toner according to the present embodiment includes a plurality of toner particles. The toner particles each include a toner mother particle and external additive particles adhering to a surface of the toner mother particle. The external additive particles include a plurality of first external additive particles and a plurality of second external additive particles. The first external additive particles have positive chargeability and are each a first silica particle having a surface treated with a positive chargeability imparting agent (referred to below as a "first positive chargeability imparting agent") and a hydrophobing agent (referred to below as a "first hydrophobing agent"). The second external additive particles have negative chargeability and are each a second silica particle having a surface treated only with a silane compound (referred to below as a "second silane compound"). The second silane compound is at least one alkylalkoxysilane represented by formula (1) shown below. The toner according to the present embodiment is preferably mixed with an electrostatic latent image developing carrier (also referred to below as a "carrier") to form a developer.

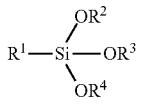

(1)

In formula (1), $R^1$ represents an alkyl group having a carbon number of at least 8 and no greater than 16. $R^2$, $R^3$, and $R^4$ each represent, independently of one another, an optionally substituted hydrocarbon group.

Hereinafter, the alkylalkoxysilane represented by formula (1) shown above is referred to as a "second alkylalkoxysilane". $R^1$ in formula (1) (more specifically, an alkyl group having a carbon number of at least 8 and no greater than 16) is referred to as a "second alkyl group".

The toner according to the present embodiment has positive chargeability, The external additive particles include positively chargeable external additive particles (first external additive particles) and negatively chargeable external additive particles (second external additive particles). As described above, the toner particles according to the present embodiment include the external additive particles (second external additive particles) having a charging polarity opposite to that of the toner. Accordingly, even if the charge of the toner is reduced, a difference in charge between the toner having a reduced charge (also referred to below as a "deteriorated toner") and the toner that is newly supplied can be restricted to a low level. Thus, the charge of the deteriorated toner can be prevented from being further reduced. As a result, occurrence of replenishment fogging can be prevented.

Besides, the toner according to the present embodiment has the above-described feature. Even if a touchdown developing method (i.e., touchdown development) is adopted in image formation, therefore, it is possible to prevent occurrence of fogging when the image formation is performed in a low temperature and low humidity environment (also referred to below as "low temperature and low humidity environment fogging"). The toner according to the present embodiment is therefore preferably used in image formation by the touchdown developing method. The following briefly describes a configuration of an image forming apparatus adopting the touchdown developing method and an image formation method in accordance with the touchdown developing method. The image forming apparatus according to the present embodiment and the image formation method according to the present embodiment are described in detail in the section of [Configuration of Image Forming Apparatus of Present Embodiment and Image Formation Method of Present Embodiment] below.

Figure 2:
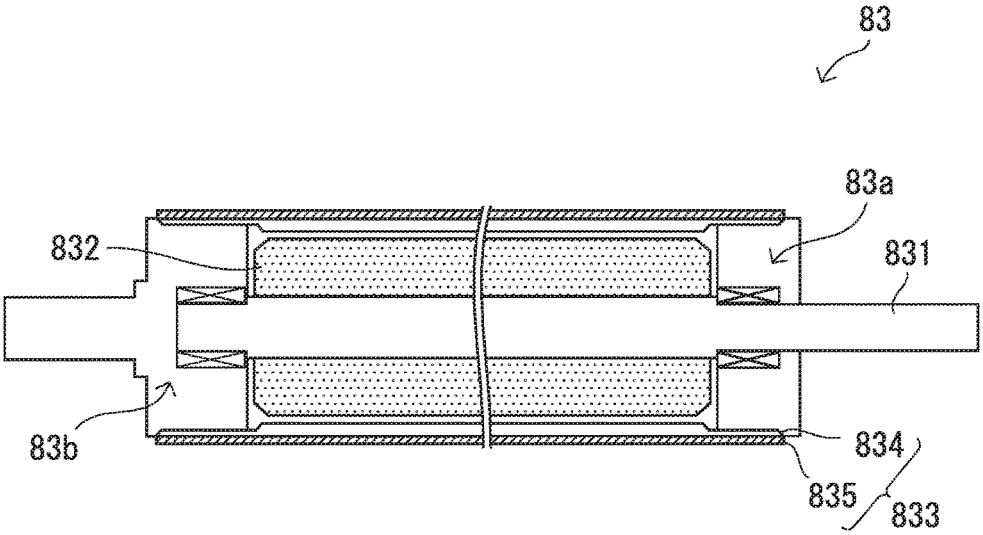
FIG. 2 is a diagram illustrating a configuration of a toner bearing member included in the image forming apparatus illustrated in FIG. 1.

FIG. 1 is a diagram illustrating a configuration of main parts of the image forming apparatus adopting the touchdown developing method. FIG. 2 is a diagram illustrating a configuration of a toner bearing member included in the image forming apparatus illustrated in FIG. 1.

The image forming apparatus adopting the touchdown developing method includes an image bearing member 11 and a development section 14 as illustrated in FIG. 1. The image bearing member 11 is equivalent to a photosensitive drum. The image bearing member 11 bears an electrostatic latent image thereon. The development section 14 develops the electrostatic latent image into a toner image. The development section 14 includes a developer bearing member 82 and a toner bearing member 83. The developer bearing member 82 is equivalent to a magnetic roller. The developer bearing member 82 bears a developer D thereon. The developer D includes the toner according to the present embodiment and a carrier for positively charging the toner by friction.

The toner bearing member 83 is equivalent to a development roller. The toner bearing member 83 receives from the developer bearing member 82 and carries thereon the toner included in a layer of the developer D (a magnetic brush layer) on a surface of the developer bearing member 82. The toner bearing member 83 is located opposite to the image bearing member 11. The toner bearing member 83 includes a shaft 831, a magnet roll 832, and a hollow cylindrical sleeve 833 as illustrated in FIG. 2. The magnet roll 832 is fixed to the shaft 831 and located inside the sleeve 833

(inside the hollow cylinder). The sleeve 833 is rotatable in a circumferential direction of the shaft 831. The sleeve 833 includes a sleeve substrate 834 and a sleeve coat layer 835. The sleeve coat layer 835 is disposed over a surface of the sleeve substrate 834.

In the image forming apparatus adopting the touchdown developing method, as illustrated in FIG. 1, the developer bearing member 82 and the toner bearing member 83 rotate while the magnetic brush layer is in contact with the toner bearing member 83. The toner bearing member 83 and the image bearing member 11 are disposed such that the toner on the surface of the toner bearing member 83 detaches therefrom and lands on the electrostatic latent image on the image bearing member 11 to develop the electrostatic latent image into a toner image.

In image formation by the touchdown developing method, the developer D is first caused to be carried as a magnetic brush layer on the surface of the developer bearing member 82. An electrostatic latent image is formed on a surface of the image bearing member 11. Next, the toner is caused to move from the surface of the developer bearing member 82 to a surface of the toner bearing member 83 through the magnetic brush layer rubbing against the surface of the toner bearing member 83 (more specifically, a surface of the sleeve coat layer 835 illustrated in FIG. 2). As a result, a toner layer is formed on the surface of the toner bearing member 83. Subsequently, the toner included in the toner layer is caused to move to the electrostatic latent image to develop the electrostatic latent image into a toner image. As described above, image formation by the touchdown developing method involves rubbing of the magnetic brush layer against the surface of the toner bearing member 83. The following describes an example of a configuration of a toner particle included in the toner with reference to FIG. 3.

Figure 3:
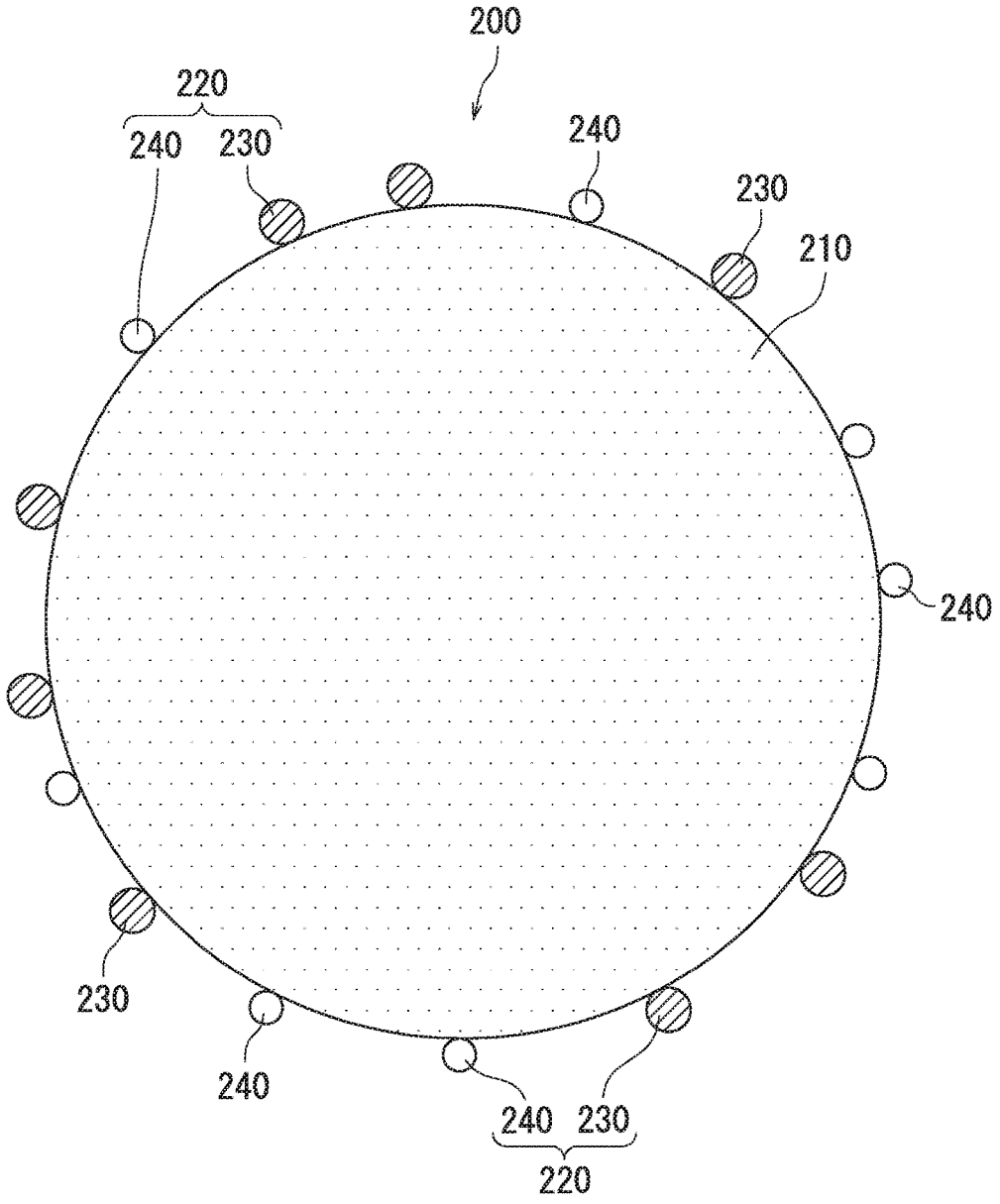
FIG. 3 is a diagram illustrating an example of a configuration of a toner particle according to an embodiment of the present disclosure.

FIG. 3 is a diagram illustrating the example of the configuration of the toner particle according to the present embodiment. A toner particle 200 illustrated in FIG. 3 includes a toner mother particle 210 and external additive particles 220 adhering to a surface of the toner mother particle 210. The external additive particles 220 include a plurality of first external additive particles 230 and a plurality of second external additive particles 240. The first external additive particles 230 have positive chargeability and are each the first silica particle having a surface treated with the first positive chargeability imparting agent and the first hydrophobing agent. The silica particles treated with a positive chargeability imparting agent tend to have positive chargeability. The second external additive particles 240 have negative chargeability and are each a second silica particle 241 (see FIG. 5) having a surface treated only with the second silane compound. The second silane compound is at least one second alkylalkoxysilane. The silica particles treated with an alkylalkoxysilane tend to have negative chargeability.

The second alkylalkoxysilane is the alkylalkoxysilane represented by formula (1) shown above. In formula (1), $R^1$ represents an alkyl group having a carbon number of at least 8 and no greater than 16 (second alkyl group). Preferably, $R^1$ represents a straight chain alkyl group having a carbon number of at least 8 and no greater than 16, a branched alkyl group having a carbon number of at least 8 and no greater than 16, or a cyclic alkyl group having a carbon number of at least 8 and no greater than 16. More preferably. $R^1$ represents a straight chain alkyl group having a carbon number of at least 8 and no greater than 16.

In formula (1) shown above, $R^2$, $R^3$, and $R^4$ each represent, independently of one another, an optionally substituted hydrocarbon group. Examples of hydrocarbon groups include straight chain hydrocarbon groups, branched hydrocarbon groups, and cyclic hydrocarbon groups. Preferably, $R^2$, $R^3$, and $R^4$ each represent, independently of one another, a methyl group or an ethyl group.

The second external additive particles 240 are treated only with the second silane compound. For example, the second external additive particles 240 are not treated with a silane compound other than the second silane compound (for example, an alkylalkoxysilane represented by formula (1) in Which $R^1$ represents an alkyl group having a carbon number of no greater than 7 or an alkyl group having a carbon number of at least 17) or with a mixture of the second silane compound and a silane compound other than the second silane compound.

When a toner in which toner particles include external additive particles having a charging polarity opposite to that of the toner is used in image formation by the touchdown developing method, the charge of the toner on the surface of the toner bearing member 83 may become lower than the charge of the toner contained in a container (for example, a developer conveyance path 81 illustrated in FIG. 1).

Figure 4:
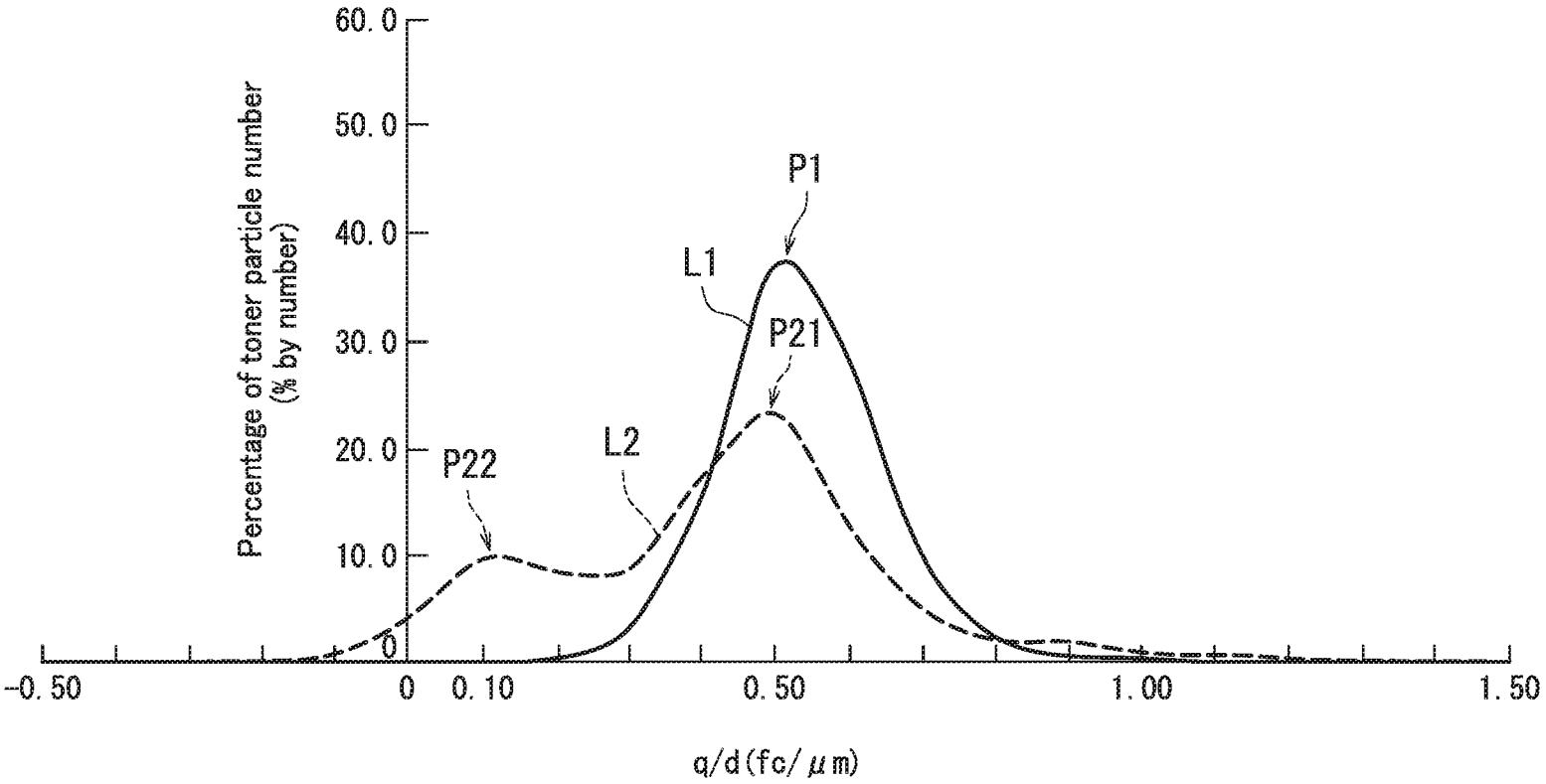
FIG. 4 is a graph showing a measurement result of particle number distribution versus q/d value.

FIG. 4 is a graph showing a measurement result of particle number distribution versus q/d value. It should be noted here that q (unit: fc) represents charge of the toner particles. Furthermore, d (unit: μm) represents particle diameter of the toner particles. In FIG. 4, the horizontal axis of the graph represents q/d. The vertical axis of the graph represents percentage of toner particle number (unit: % by number). A curve L1 represents particle number distribution versus q/d value with respect to the toner contained in the container. A curve L2 represents particle number distribution versus q/d value with respect to the toner on the surface of the toner bearing member 83. The curve L1 has a peak P1 where q/d is approximately 0.50 fc/μm. The curve L2 has a peak P21 where q/d is approximately 0.50 fc/μm and a peak P22 where q/d is approximately 0.10 fc/μm. The results indicate that the charge of the toner on the surface of the toner bearing member 83 is lower than the charge of the toner contained in the container.

However, the toner particles 200 according to the present embodiment include the second external additive particles 240. The second silica particles 241 of the second external additive particles 240 can be prevented from coming in contact with the sleeve coat layer 835 even if the magnetic brush layer rubs against the surface of the toner bearing member 83 (see FIG. 5).

Figure 5:
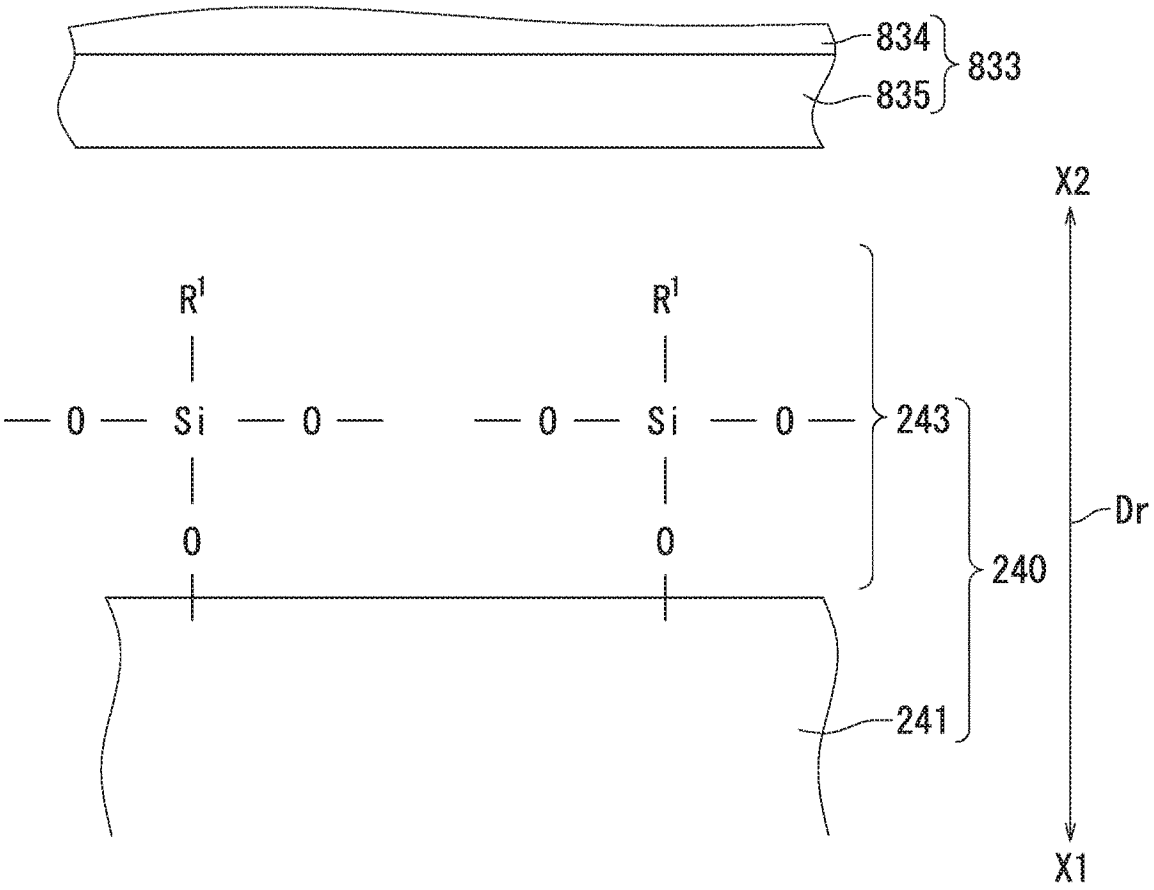
FIG. 5 is a diagram illustrating a surface of a second external additive particle and the vicinity thereof in a situation in which a magnetic brush layer rubs against a surface of the toner bearing member.

FIG. 5 is a diagram illustrating a surface of a second external additive particle and the vicinity thereof in a situation in which the magnetic brush layer rubs against the surface of the toner bearing member. Note that in FIG. 5, a surface of the second silica particle 241 is depicted by a straight line for simplicity. Furthermore, in FIG. 5, "Dr" represents a radial direction of a toner particle 200, "X1" represents a radially inner side of the toner particle 200, and "X2" represents a radially outer side of the toner particle 200. Furthermore, in FIG. 5, "$R^1$" represents the second alkyl group.

It is thought that in a situation in which the surfaces of the second silica particles 241 are treated only with the second silane compound, a dehydration reaction occurs between a hydrolysate of the second silane compound and hydroxyl groups (un-bonded hydroxyl groups) present in the surfaces of the second silica particles 241. The dehydration reaction yields the second external additive particles 240. The thus produced second external additive particles 240 are modified silica particles that are each the second silica particle 241 having a surface chemically-modified only with a modifying group (referred to below as a second modifying group) 243 of a structure represented by formula (2) shown below.

(2)

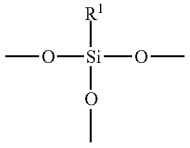

In formula (2), $R^1$ represents an alkyl group having a carbon number of at least 8 and no greater than 16 (i.e., second alkyl group). In formula (2), oxygen atoms have three available bonds. More specifically, each of the three oxygen atoms in formula (2) has one available bond, which is a bond not bonded to a silicon atom in formula (2). One of the three available bonds is bonded to a silicon atom forming the silica contained in the second silica particles 241. Remaining two of the three available bonds are each independently bonded to an optionally substituted hydrocarbon group for a termination. Hydrocarbon groups include straight chain hydrocarbon groups, branched hydrocarbon groups, and cyclic hydrocarbon groups. Preferably, the remaining two available bonds are each independently bonded to a methyl group or an ethyl group for a termination. For example, in a case of a reaction between an alkoxy group $OR^2$ of the second alkylalkoxysilane and a hydroxyl group present in the surfaces of the second silica particles 241, one of the remaining two available bonds is bonded to an alkyl group (preferably, a methyl group or an ethyl group) $R^3$ for a termination, and the other of the remaining two available bonds is bonded to an alkyl group (preferably, a methyl group or an ethyl group) $R^4$ for a termination.

More specifically, the surface of each second silica particle 241 is modified with a plurality of the second modifying groups 243 as illustrated in FIG. 5. Each second modifying group 243 includes a silicon atom (Si), three oxygen atoms (O) bonded to the silicon atom through covalent bonds, and the second alkyl group bonded to the silicon atom through a covalent bond. Since the second alkyl group has a carbon number of at least 8 and no greater than 16, the second alkyl group is a bulky substituent group. Accordingly, the second alkyl group tends to be present further toward the radially outer side X2 of the toner particle 200 than the silicon atom in the second modifying group 243 as illustrated in FIG. 5.

According to the present embodiment, as described above, a bulky substituent group tends to be present at the radially outer side X2 of the toner particle 200. The second modifying group 243 therefore functions as a steric barrier when the magnetic brush layer rubs against the surface of the toner bearing member 83 (see FIG. 1). Since the steric barrier can prevent the second silica particles 241 from coming in contact with the sleeve coat layer 835, triboelectric charging can be prevented from occurring between the sleeve coat layer 835 and the second silica particles 241. As a result, the sleeve coat layer 835 can be prevented from being positively charged, and the second silica particles 241 can be prevented from being negatively charged.

Since the sleeve coat layer 835 can be prevented from being positively charged, accumulation of positive charge in the sleeve coat layer 835 can be prevented even in a case of image formation in a low temperature and low humidity environment. Thus, the second silica particles 241 can be prevented from being negatively charged even in a case of image formation in a low temperature and low humidity environment. Accordingly, the toner according to the present embodiment can be prevented from being negatively charged. Consequently, occurrence of low temperature and low humidity environment fogging can be prevented. The following further describes the second same compound.

If the second alkyl group is an alkyl group having a carbon number of less than 8, the second silica particles 241 may come in contact with the sleeve coat layer 835. In such a situation, the sleeve coat layer 835 may be positively charged. Consequently, low temperature and low humidity environment fogging may occur. However, as long as the second alkyl group is an alkyl group having a carbon number of at least 8, the second silica particles 241 can be prevented from coming in contact with the sleeve coat layer 835, and thus occurrence of low temperature and low humidity environment fogging can be prevented.

If the second alkyl group is an alkyl group having a carbon number of greater than 16 (referred to below as "a long-chain alkyl group"), the long-chain alkyl group functions as a steric barrier, making the dehydration reaction between the hydrolysate of the second silane compound and the hydroxyl groups (un-bonded hydroxyl groups) present in the surfaces of the second silica particles 241 (also referred to below simply as "dehydration reaction") less likely to occur. The surfaces of the second silica particles 241 are therefore difficult to be chemically modified with the second modifying group 243. As a result, the second silica particles 241 are of insufficient hydrophobic character, and therefore the second silica particles 241 are susceptible to moisture. Consequently, chargeability of the toner tends to decrease, and the decrease in chargeability of the toner tends to cause toner scattering or fogging. Furthermore, as a result of the long-chain alkyl group functioning as a steric barrier making the dehydration reaction less likely to occur, molecules of the second silane compound may react with one another in the surfaces of the second silica particles 241 to cause aggregation of the second external additive particles 240. The aggregated second external additive particles 240 fail to appropriately function as an external additive, allowing fogging to occur easily. However, as long as the second alkyl group is an alkyl group having a carbon number of no greater than 16, the second alkyl group tends not to be a steric barrier in the dehydration reaction. As long as the second alkyl group is an alkyl group having a carbon number of no greater than 16, therefore, the problem that may arise if the second alkyl group is a long-chain alkyl group can be prevented. Furthermore, occurrence of replenishment fogging can be prevented. Furthermore, occurrence of low temperature and low humidity environment fogging can be prevented.

Examples of the second silane compounds that can be preferably used include n-octyltrimethoxysilane, n-octyltriethoxysilane, n-decyltrimethoxysilane, n-decyltriethoxysilane, n-dodecyltrimethoxysilane, n-dodecyltriethoxysilane, n-hexadecyltrimethoxysilane, and n-hexadecyltriethoxysilane. The second silane compound may include one second alkylalkoxysilane or may include two or more second alkylalkoxysilanes.

Preferably, the second silane compound does not include an alkylalkoxysilane having an alkyl group having a carbon number of less than 8 (referred to below as "a short-chain alkylalkoxysilane"). In a situation in which the second silane compound includes a short-chain alkylalkoxysilane and a second alkylalkoxysilane, hydroxyl groups (un-bonded hydroxyl groups) present in the surfaces of the second silica particles 241 react not only with the hydrolysate of the second alkylalkoxysilane but also with a hydrolysate of the short-chain alkylalkoxysilane. Thus, the probability of the reaction between the un-bonded hydroxyl groups and the hydrolysate of the second alkylalkoxysilane decreases. Accordingly, the yield of the second external additive particles 240 decreases. This makes it difficult to prevent occurrence of low temperature and low humidity environment fogging (see Comparative Example 4 described below).

Preferably, the second silane compound does not include an alkylalkoxysilane having a long-chain alkyl group (referred to below as a "long-chain alkylalkoxysilane"). In a situation in which the second silane compound includes a long-chain alkylalkoxysilane and a second alkylalkoxysilane, the long-chain alkyl group functions as a steric barrier, making the dehydration reaction less likely to occur. The surfaces of the second silica particles 241 are therefore difficult to be chemically modified with the second modifying group 243. As a result, the second silica particles 241 are of insufficient hydrophobic character, and the second silica particles 241 are susceptible to moisture. Consequently, chargeability of the toner tends to decrease, and the decrease in chargeability of the toner tends to cause toner scattering or fogging. Furthermore, as a result of the long-chain alkyl group functioning as a steric barrier making the dehydration reaction less likely to occur, molecules of the second silane compound may react with one another in the surfaces of the second silica particles 241 to cause aggregation of the second external additive particles 240. The aggregated second external additive particles 240 fail to appropriately function as an external additive, allowing fogging to occur easily. Through the above, the feature of the toner according to the present embodiment has been described in detail with reference to FIGS. 1 to 3 and 5. The following describes a composition of the first external additive particles.

The first external additive particles are each the first silica particle having a surface treated with the first positive chargeability imparting agent and the first hydrophobing agent. More specifically, the first external additive particles are preferably modified silica particles that are each the first silica particle having a surface chemically-modified with a positively chargeable functional group and a hydrophobic group (referred to below as a "first hydrophobic group").

The surface treatment of the first silica particles with the first positive chargeability imparting agent involves a dehydration reaction between a hydrolysate of the first positive chargeability imparting agent and hydroxyl groups (un-bonded hydroxyl groups) present in the surfaces of the first silica particles. The surface treatment of the first silica particles with the first hydrophobing agent involves a dehydration reaction between a hydrolysate of the first hydrophobing agent and hydroxyl groups (un-bonded hydroxyl groups) present in the surfaces of the first silica particles. These dehydration reactions yield the first external additive particles.

Preferably, an agent containing nitrogen atoms in molecules thereof is used as the first positive chargeability imparting agent. Accordingly, the positively chargeable functional group tends to contain a nitrogen atom. Preferably, the positively chargeable functional group is derived from any of compounds listed as examples of the first positive chargeability imparting agent described in the section of <First Positive Chargeability Imparting Agent> below. Preferably, an agent containing hydrocarbon groups in molecules thereof is used as the first hydrophobing agent. Accordingly, the first hydrophobic group tends to contain a hydrocarbon group. Preferably, the first hydrophobic group is a hydrocarbon group having a carbon number of at least 1 and no greater than 5. Hydrocarbon groups include straight chain hydrocarbon groups, branched hydrocarbon groups, and cyclic hydrocarbon groups. Preferably, the first hydrophobic group is derived from any of compounds listed as examples of the first hydrophobing agent described in the section of <First Hydrophobing Agent> below.

The following describes an amount of the first external additive particles and an amount of the second external additive particles. Preferably, the amount of the first external additive particles and the amount of the second external additive particles satisfy (a) to (c) shown below. As a result, the difference between the charge of the deteriorated toner and the charge of the newly supplied toner can be restricted to a lower level. Thus, occurrence of replenishment fogging can be further prevented.

(a) The amount of the first external additive particles is at least 1.20 parts by mass and no greater than 2.00 parts by mass relative to 100.00 parts by mass of the toner mother particles.

(b) The amount of the second external additive particles is at least 0.20 parts by mass and no greater than 0.60 parts by mass relative to 100.00 parts by mass of the toner mother particles.

(c) A ratio of die amount of the second external additive particles to the amount of the first external additive particles is at least 0.100 and no greater than 0.400.

More preferably, the amount of the first external additive particles is at least 1.20 parts by mass and no greater than 1.60 parts by mass relative to 100.00 parts by mass of the toner mother particles, the amount of the second external additive particles is at least 0.30 parts by mass and no greater than 0.50 parts by mass relative to 100.00 parts by mass of the toner mother particles, and the ratio of the amount of the second external additive particles to the amount of the first external additive particles is at least 0.10 and no greater than 0.40.

[Production Method of Toner of Present Embodiment]

A preferable production method of the toner according to the present embodiment includes a toner mother particle preparation process, a first external additive preparation process, a second external additive preparation process, and an external additive addition process. The first external additive as used herein refers to a powder composed of a number of the first external additive particles. The second external additive as used herein refers to a powder composed of a number of the second external additive particles. Preferably, a large number of the toner particles are formed at the same time in order that the toner can be produced efficiently. Toner particles that are produced at the same time are thought to have substantially the same structure as one another.

<Toner Mother Particle Preparation Process>

In the case of a capsule toner, the toner mother particles are preferably prepared by performing a toner core preparation process and a shell layer formation process in the stated order. In the case of a non-capsule toner, the toner mother particles are preferably prepared without performing the shell layer formation process. The capsule toner used herein refers to toner particles each including a toner core and a shell layer. The shell layer is disposed over a surface of the toner core. The non-capsule toner used herein refers to toner particles each including a toner core and no shell layer. In the case of the non-capsule toner, the toner cores are equivalent to the toner mother particles.

(Toner Core Preparation Process)

Preferably, the toner cores are prepared by a known aggregation method or a known pulverization method. The toner cores can be readily prepared by such a known method.

(Shell Layer Formation Process)

The shell layers may for example be formed according to an in-situ polymerization process, an in-liquid curing film coating process, or a coacervation process.

<First External Additive Preparation Process>

Preferably, the first external additive preparation process includes a first silica particle preparation process and a first treatment process. Preferably, a large number of the first external additive particles are prepared at the same time in order that the first external additive can be prepared efficiently. First external additive particles that are prepared at the same time are thought to have substantially the same structure as one another.

(First Silica Particle Preparation Process)

Preferably, the first silica particles are prepared by a dry process or a wet process. More preferably, the first silica particles are prepared by a fuming process.

(First Treatment Process)

Preferably, the thus prepared first silica particles are subjected to a positive chargeability imparting treatment and a hydrophobing treatment. Preferably, the surfaces of the first silica particles are treated with the first positive chargeability imparting agent in the positive chargeability imparting treatment. Preferably, the surfaces of the first silica particles are treated with the first hydrophobing agent in the hydrophobing treatment. Examples of methods by which the surfaces of the first silica particles are treated include methods 1 and 2 described below. A treatment agent used in the following methods 1 and 2 refers to at least one of the first positive chargeability imparting agent and the first hydrophobing agent. Preferably, the first silica particles are heated after the surface treatment of the first silica particles. Thus, the first external additive including a number of the first external additive particles is obtained.

Method 1: A treatment agent is dripped or sprayed onto the first silica particles under stirring at a high speed.

Method 2: First, a treatment agent is dissolved in an organic solvent to prepare a treatment liquid. Next, the first silica particles are soaked in the treatment liquid under stirring.

<Second External Additive Preparation Process>

The second external additive preparation process includes a second silica particle preparation process and a second treatment process. Preferably, a large number of the second external additive particles are prepared at the same time in order that the second external additive can be prepared efficiently. Second external additive particles that are prepared at the same time are thought to have substantially the same structure as one another.

(Second Silica Particle Preparation Process)

Preferably, the second silica particles are prepared by the same process as or a similar process to the preparation process of the first silica particles.

(Second Treatment Process)

The thus prepared second silica particles are subjected to a hydrophobing treatment. The surfaces of the second silica particles are treated only with the second silane compound in the hydrophobing treatment. Examples of methods by which the surfaces of the second silica particles are treated include a method described below. The surfaces of the second silica particles are treated only with a hydrolysate of the second silane compound while the second silica particles are stirred. Preferably, stirring of the second silica particles and hydrolysis of the second silane compound are carried out at the same time. Preferably, the second silica particles are heated after the surface treatment of the second silica particles. Thus, the second external additive including a number of the second external additive particles is obtained.

<External Additive Addition Process>

A mixer (for example, an FM mixer, product of Nippon Coke & Engineering Co., Ltd.) is used to mix the toner mother particles, the first external additive, and the second external additive. Through the above, the first external additive particles and the second external additive particles adhere to the surfaces of the toner mother particles by electrostatic interaction. Thus, a toner including a number of the toner particles is obtained.

A commercially available product may be used as the first external additive. In such a situation, the first external additive preparation process can be omitted. Likewise, a commercially available product may be used as the second external additive. In such a situation, the second external additive preparation process can be omitted.

[Configuration of Image Forming Apparatus of Present Embodiment and Image Formation Method of Present Embodiment]

Figure 6:
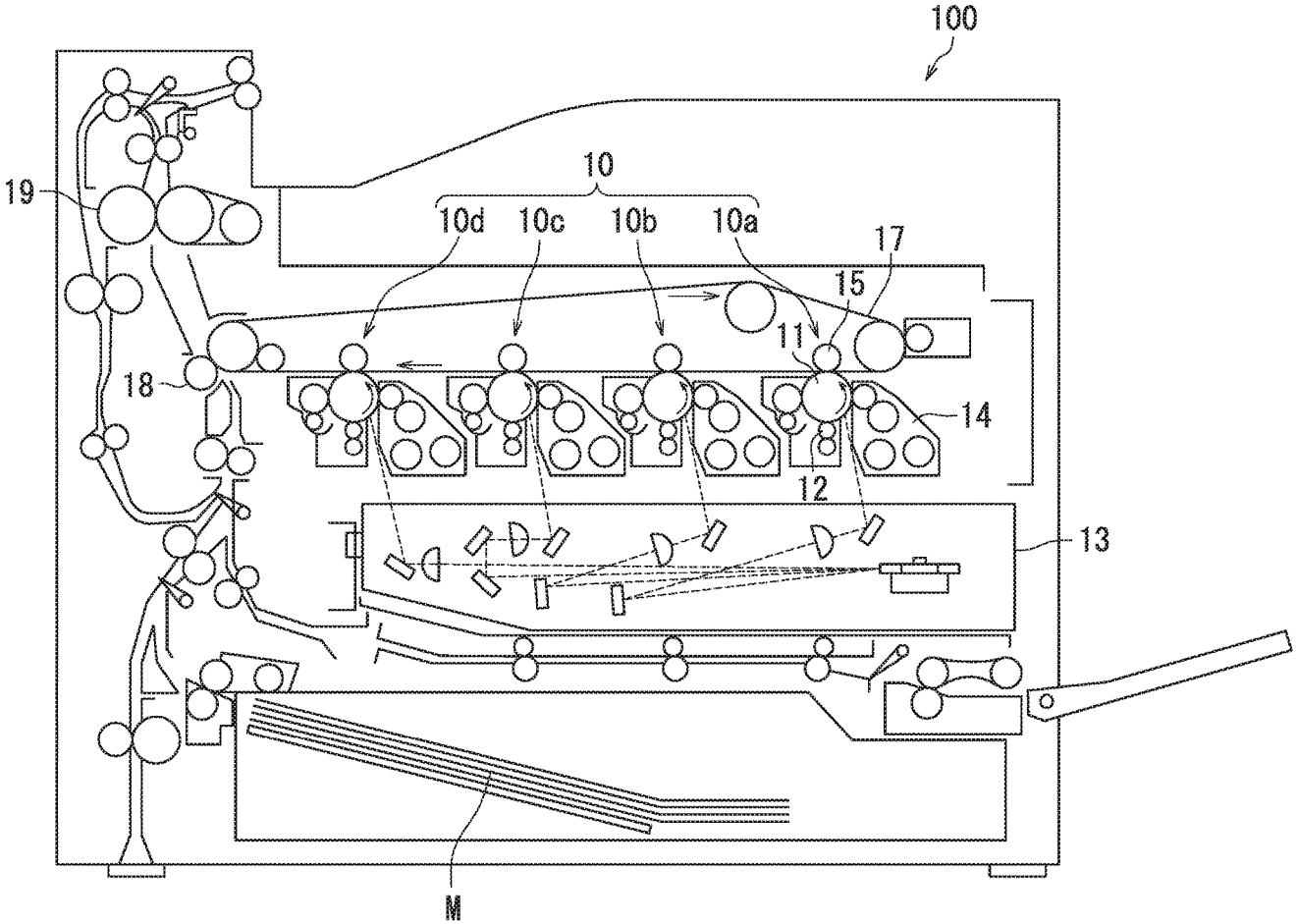
FIG. 6 is a diagram illustrating an example of a configuration of the image forming apparatus according to the embodiment of the present disclosure.

The following describes an image formation method according to the present embodiment while describing a configuration of an image forming apparatus according to the present embodiment with reference to FIG. 6. FIG. 6 is a diagram illustrating an example of the configuration of the image forming apparatus according to the present embodiment. An image forming apparatus 100 illustrated in FIG. 6 forms an image using the developer D (see FIG. 1). The developer D includes the toner according to the present embodiment and a carrier for positively charging the toner by friction. The image forming apparatus 100 illustrated in FIG. 6 adopts the touchdown developing method.

The image forming apparatus 100 illustrated in FIG. 6 includes image bearing members 11 and development sections 14. The image forming apparatus 100 may further include chargers 12, a light exposure section 13, a transfer section, a transfer belt 17, and a fixing section 19 as necessary. The image forming apparatus 100 may include only primary transfer sections 15 or may include both the primary transfer sections 15 and a secondary transfer section 18 as the transfer section.

The image forming apparatus 100 includes image formation units 10*a*, 10*b*, 10*c*, and 10*d*. Hereinafter, the image formation units 10*a*, 10*b*, 10*c*, and 10*d* are each referred to as an image formation unit 10 unless they need to be distinguished from one another. The image formation unit 10 includes the image bearing member 11, the charger 12, the development section 14, and the primary transfer section 15. The image bearing member 11 is disposed at a center of the image formation unit 10. The image bearing member 11 is rotatable in a direction indicated by an arrow (counterclockwise). Around the image bearing member 11, the charger 12, the development section 14, and the primary transfer section 15 are arranged in the stated order from upstream to downstream in the rotation direction of the image bearing member 11.

The image formation method performed using the image forming apparatus 100 involves a development process. Preferably, the image formation method performed using the image forming apparatus 100 involves the development process and at least one of a charging process, a light exposure process, and a transfer process.

In the charging process, the charger 12 charges a surface of the image bearing member 11 to a positive polarity. Examples of the charger 12 include a non-contact charger and a contact charger. Examples of non-contact chargers that can be used include a corotron charging device or a scorotron charging device. Examples of contact chargers that can be used include a charging roller and a charging brush.

In the light exposure process, the light exposure section 13 exposes the charged surface of the image bearing member 11 to light. As a result, an electrostatic latent image is formed on the surface of the image bearing member 11. The image bearing member 11 bears the formed electrostatic latent image thereon.

In the development process, the development section 14 supplies the toner (a number of toner particles) from the developer D to the electrostatic latent image on the image bearing member 11. Thus, the electrostatic latent image is developed into a toner image. The development section 14 is described below.

The transfer process may for example be performed according to an intermediate transfer process or a direct transfer process. According to the intermediate transfer process, the primary transfer section 15 performs primary transfer in which the toner image is transferred from the image bearing member 11 to the transfer belt 17. Thereafter, the secondary transfer section 18 performs secondary transfer in which the toner image is transferred from the transfer belt 17 to a recording medium M.

According to the direct transfer process, the primary transfer section 15 transfers the toner image from the image bearing member 11 to the recording medium M being conveyed by the transfer belt 17. According to the direct transfer process, the image bearing member 11 and the recording medium M come in contact with each other when the toner image is transferred to the recording medium M. The secondary transfer section 18 is omitted in the case of the image forming apparatus 100 adopting the direct transfer process. Toner remaining on the surface of the image bearing member 11 after the transfer process may be cleaned by a cleaning section as necessary.

After the toner image is transferred to the recording medium M, the fixing section 19 fixes the unfixed toner image through application of either or both of heat and pressure in the fixing process. Through the above, an image is formed on the recording medium M.

<Development Section and Development Process>

The following further describes the development section 14 and the development process with reference to FIG. 1. As illustrated in FIG. 1, the development section 14 includes a housing 80, the developer conveyance path 81, a developer restricting member 84, and a developer stirring conveyance member 85 in addition to the developer bearing member 82 and the toner bearing member 83. The developer restricting member 84 is equivalent to a developer restricting blade. The developer conveyance path 81, the developer bearing member 82, the toner bearing member 83, the developer restricting member 84, and the developer stirring conveyance member 85 are housed in the housing 80. The developer conveyance path 81 contains the developer D.

The housing 80 includes a partition wall 801. The developer conveyance path 81 includes two conveyance paths (conveyance paths 811 and 812). The conveyance path 811 and the conveyance path 812 extend substantially in parallel to each other. The partition wall 801 is located between the conveyance path 811 and the conveyance path 812.

The developer stirring conveyance member 85 includes two conveyance screws (conveyance screws 851 and 852). The conveyance screw 8.51 is disposed in the conveyance path 811. The conveyance screw 852 is disposed in the conveyance path 812. The conveyance screw 851 and the conveyance screw 852 are arranged substantially in parallel to each other.

The conveyance screw 851 rotates to stir and convey the developer D in the conveyance path 811. The conveyance screw 852 rotates to stir and convey the developer D in the conveyance path 812. As a result, the developer D is conveyed while circulating between the conveyance path 811 and the conveyance path 812.

The developer bearing member 82 is located opposite to the developer stirring conveyance member 85 and rotatably supported by the housing 80. A cylindrical magnet (not shown) is non-rotatably fixed inside the developer bearing member 82. The magnet has a plurality of magnetic poles including a pump pole 821, a restriction pole 822, and a main pole 823, for example. The pump pole 821 is located opposite to the developer stirring conveyance member 85. The restriction pole 822 is located opposite to the developer restricting member 84. The main pole 823 is located opposite to the toner bearing member 83.

The developer bearing member 82 magnetically pumps up (attracts) the developer D from the developer conveyance path 81 onto a circumferential surface 82*s* of the developer bearing member 82 by magnetic force of the pump pole 821. The developer bearing member 82 bears the pumped-up developer D thereon. More specifically, the pumped-up developer D is magnetically carried on the circumferential surface 82*s* of the developer bearing member 82 as a layer of the developer D (magnetic brush layer). The developer D on the developer bearing member 82 is conveyed to the developer restricting member 84 as the developer bearing member 82 rotates.

The developer restricting member 84 is located downstream of the developer stirring conveyance member 85 in a rotation direction of the developer bearing member 82. The developer restricting member 84 restricts the thickness of the magnetic brush layer. The developer restricting member 84 extends in a longitudinal direction of the developer bearing member 82. The developer restricting member 84 is for example a plate member formed from a magnetic material. The developer restricting member 84 is supported by a support member 841 fixed to the housing 80. The developer restricting member 84 has a restriction surface 842. The restriction surface 842 is equivalent to an end surface of the developer restricting member 84. A gap (also referred to as a restriction gap) G1 is provided between the restriction surface 842 and the circumferential surface 82*s* of the developer bearing member 82.

The developer restricting member 84 is magnetized by the restriction pole 822 of the developer bearing member 82. As a result, a magnetic path is formed in the gap G1. The magnetic brush layer is conveyed into the gap G1 as the developer bearing member 82 rotates. The thickness of the magnetic brush layer is then restricted in the gap G1. Through the above, the magnetic brush layer with a specific thickness is formed on the circumferential surface 82*s* of the developer bearing member 82.

The toner bearing member 83 is located downstream of the developer restricting member 84 in the rotation direction of the developer bearing member 82. The toner bearing member 83 is located opposite to the developer bearing member 82 and rotatably supported by the housing 80. A gap G2 is provided between a circumferential surface 83*s* of the toner bearing member 83 and the circumferential surface 82*s* of the developer bearing member 82.

The toner bearing member 83 rotates while being in contact with the magnetic brush layer. At the gap G2, specific bias is applied to the toner bearing member 83, and specific bias is applied to the developer bearing member 82. An absolute value $V_{83}$ of the bias applied to the toner bearing member 83 is smaller than an absolute value $V_{82}$ of the bias applied to the developer bearing member 82. As a result, a specific potential difference is generated between the circumferential surface 83*s* of the toner bearing member 83 and the circumferential surface 82*s* of the developer bearing member 82. The charging polarity of the toner is for example the same as the polarity of the bias applied to the toner bearing member 83 and the developer bearing member 82. Therefore, the generated potential difference causes the toner (a number of toner particles) to move from the magnetic brush layer to the circumferential surface 83*s* of the toner bearing member 83. The carrier (a number of carrier particles) contained in the magnetic brush layer remains on the circumferential surface 82*s* of the developer bearing member 82. Through the above, the toner bearing member 83 receives the toner contained in the magnetic brush layer from the developer bearing member 82. The toner bearing member 83 then bears the received toner thereon. As a result, a layer of the toner (a number of toner particles) is formed on the circumferential surface 83*s* of the toner bearing member 83.

The toner bearing member 83 is located opposite to the image bearing member 11 with an opening of the housing 80 therebetween. A gap G3 is provided between the circumferential surface 83*s* of the toner bearing member 83 and a circumferential surface 11*s* of the image bearing member 11.

The layer of the toner (a number of toner particles) formed on the circumferential surface 83*s* of the toner bearing member 83 is conveyed toward the circumferential surface 11*s* of the image bearing member 11 as the toner bearing member 83 rotates. At the gap G3, specific bias is applied to the toner bearing member 83. An absolute value $V_{83}$ of the bias applied to the toner bearing member 83 is larger than an absolute value $V_{11E}$ of a surface potential of an exposed region of the image bearing member 11. The absolute value $V_{83}$ of the bias applied to the toner bearing member 83 is smaller than an absolute value $V_{11UE}$ of a surface potential of an unexposed region of the image bearing member 11. As a result, a specific potential difference is generated between the circumferential surface 11*s* of the image bearing member 11 and the circumferential surface 83*s* of the toner bearing member 83. The charging polarity of the toner is for example the same as the polarity of the bias applied to the toner bearing member 83 and the charging polarity of the image bearing member 11. Therefore, the generated potential difference causes the toner (a number of toner particles) to move from the layer of the toner on the circumferential surface 83*s* of the toner bearing member 83 to the exposed region of the circumferential surface 11*s* of the image bearing member 11. Thus, the toner bearing member 83 supplies the toner to the electrostatic latent image on the image bearing member 11. The electrostatic latent image (corresponding to the exposed region) on the circumferential surface 11*s* of the image bearing member 11 is then developed into a toner image.

<Toner Bearing Member>

The following further describes the configuration of the toner bearing member 83 with reference to FIG. 2. As described above, the toner bearing member 83 includes the shaft 831, the magnet roll 832, and the hollow cylindrical sleeve 833. The magnet roll 832 has magnetic poles at least in a surface portion thereof. Examples of magnetic poles of the magnet roll 832 include north and south poles based on permanent magnets.

The sleeve 833 is located in the surface portion of the toner bearing member 83 and is supported so as to be rotatable about the shaft 831. More specifically, the shaft 831 and the sleeve 833 are connected by flanges 83*a* and 83*b* such that the sleeve 833 is rotatable around the non-rotatable magnet roll 832. Such a structure enables the sleeve 833 to rotate in the circumferential direction of the shaft 831.

The sleeve 833 includes the sleeve substrate 834 and the sleeve coat layer 835. The sleeve coat layer 835 is formed on the surface of the sleeve substrate 834. Preferably, the sleeve coat layer 835 contains a urethane resin.

The urethane resin has positive chargeability. It is therefore easy to positively charge the sleeve coat layer 835 containing a urethane resin. The positively charged toner and the positively charged sleeve coat layer 835 therefore tend to electrically repel each other. Thus, non-adhering properties of the toner with respect to the sleeve coat layer 835 can be improved. As a result, an image excellent in terms of image quality and image density can be formed. More preferably, the sleeve coat layer 835 is formed of a urethane resin. The following describes the urethane resin.

(Urethane Resin)

The urethane resin is for example synthesized through copolymerization of a polyol and a polyisocyanate in accordance with a known urethane resin synthesis method. The urethane resin can be used in the form of an aqueous dispersion obtained through self-emulsifying of a prepolymer or a polymer in water or in the form of a dispersion obtained through emulsifying of a prepolymer or a polymer using a surfactant.

(Polyol)

Preferably, the polyol is for example a polyester polyol or a polyether polyol.

Preferably, the polyester polyol is for example a compound obtained through polycondensation of at least one dicarboxylic acid and at least one polyhydric alcohol or a compound obtained through ring-opening polymerization of a lactone.

Examples of dicarboxylic acids that can be preferably used include succinic acid, glutaric acid, adipic acid, sebacic acid, azelaic acid, maleic acid, fumaric acid, phthalic acid, and terephthalic acid.

Examples of polyhydric alcohols that can be preferably used include ethylene glycol, propylene glycol, 1,4-butanediol, 1,3-butanediol, 1,6-hexanediol, neopentyl glycol, 1,8-octanediol, 1,10-decanediol, diethylene glycol, spiroglycol, and trimethylolpropane.

Examples of polyether polyols that can be preferably used include compounds each obtained through ring-opening addition polymerization of a cyclic ether with one of the polyhydric alcohols usable for synthesis of the above-described polyester polyol, compounds each obtained through ring-opening addition polymerization of a cyclic ether with an aromatic diol, compounds each obtained through ring-opening addition polymerization of a cyclic ether with a primary amine, and compounds each obtained through ring-opening addition polymerization of a cyclic ether with a secondary amine. Examples of aromatic dials that can be preferably used include bisphenol A. Examples of cyclic ethers that can be preferably used include ethylene oxide, propylene oxide, oxetane, and tetrahydrofuran.

More specific examples of polyether polyols that can be preferably used include polyoxyethylene polyols, polyoxypropylene polyols, polyoxytetramethylene polyols, bisphenol A propylene oxide adducts, and bisphenol A ethylene oxide adducts.

(Polyisocyanate)

Preferably, the polyisocyanate is for example a diisocyanate. Examples of diisocyanates that can be preferably used include aliphatic diisocyanates, alicyclic diisocyanates, and aromatic diisocyanates. Examples of aliphatic diisocyanates that can be preferably used include ethylene diisocyanate, 2,2,4-trimethyl hexamethylene diisocyanate, and 1,6-hexamethylene diisocyanate. Examples of alicyclic diisocyanates that can be preferably used include hydrogenated 4,4'-diphenylmethane diisocyanate, 1,4-cyclohexane diisocyanate, methylcyclohexylene diisocyanate, isophorone diisocyanate, and norbornane diisocyanate. Examples of aromatic diisocyanates that can be preferably used include 4,4'-diphenylmethane diisocyanate, xylylene diisocyanate, toluene diisocyanate, and naphthalene diisocyanate. Through the above, the image forming apparatus and the image formation method according to the present embodiment have been described with reference to FIGS. 1, 2, and 6. The following describes examples of materials and properties of the toner mother particles, materials and properties of the first external additive particles, and properties of the second external additive particles in the stated order.

[Examples of Materials and Properties of Toner Mother Particles]

In the case of a capsule toner, the toner mother particles each preferably include a toner core and a shell layer described below. In the case of a non-capsule toner, the toner mother particles are each equivalent to the toner core described below.

<Toner Core>

The toner cores contain a binder resin. The toner cores may further contain at least one of a colorant, a releasing agent, a charge control agent, and a magnetic powder.

(Binder Resin)

The binder resin is typically a main component (for example, at least 85% by mass) of the toner cores. Accordingly, properties of the binder resin are thought to have a great influence on overall properties of the toner cores.

Properties (specific examples include hydroxyl value, acid value, glass transition point, and softening point) of the binder resin can be adjusted by using different resins in combination for the binder resin. The toner cores have a higher tendency to be anionic in a situation in which the binder resin has, for example, an ester group, a hydroxyl group, an ether group, an acid group, or a methyl group. The toner cores have a higher tendency to be cationic in a situation in which the binder resin has an amino group or an amide group. In order that the binder resin is strongly anionic, the binder resin preferably has a hydroxyl value and an acid value, at least one of which is at least 10 mg KOH/g.

Preferably, the toner cores contain a thermoplastic resin. Examples of thermoplastic resins that can be used include polyester resins, styrene-based resins, acrylic acid-based resins, olefin-based resins, vinyl resins, polyamide resins, and urethane resins. Examples of acrylic acid-based resins that can be used include acrylic acid ester polymers and methacrylic acid ester polymers. Examples of olefin-based resins that can be used include polyethylene resins and polypropylene resins. Examples of vinyl resins that can be used include vinyl chloride resins, polyvinyl alcohols, vinyl ether resins, and N-vinyl resins. Furthermore, copolymers of the resins listed above, that is, copolymers obtained through incorporation of a repeating unit into any of the resins listed above may be used as the thermoplastic resin to form the toner particles. For example, styrene-acrylic acid-based resins and styrene-butadiene-based resins can be used as the thermoplastic resin to form the toner cores. The following describes a polyester resin, which is an example of the binder resin, in detail.

The polyester resin is synthesized through polycondensation of at least one alcohol and at least one carboxylic acid. Examples of alcohols that can be used in synthesis of the polyester resin include dihydric alcohols and tri- or higher-hydric alcohols shown below. Examples of dihydric alcohols that can be used include diols and bisphenols. Examples of carboxylic acids that can be used in synthesis of the polyester resin include di-, tri-, and higher-basic carboxylic acids shown below.

Examples of diols that can be used include ethylene glycol, diethylene glycol, triethylene glycol, 1,2-propanediol, 1,3-propanediol, 1,4-butanediol, neopentyl glycol, 2-butene-1,4-diol, 1,5-pentanediol, 1,6-hexanediol, 1,4-cyclohexanedimethanol, dipropylene glycol, polyethylene glycol, polypropylene glycol, and polytetramethylene glycol.

Examples of bisphenols that can be used include bisphenol A, hydrogenated bisphenol A, bisphenol A ethylene oxide adduct, and bisphenol A propylene oxide adduct.

Examples of tri- or higher-hydric alcohols that can be used include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of di-basic carboxylic acids that can be used include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (more specifically, n-butylsuccinic acid, isobutylsuccinic acid, n-octylsuccinic acid, n-dodecylsuccinic acid, and isododecylsuccinic acid), and alkenyl succinic acids (more specifically, n-butenylsuccinic acid, isobutenylsuccinic acid, n-octenylsuccinic acid, n-dodecenylsuccinic acid, and isododecenylsuccinic acid).

Examples of tri- or higher-basic carboxylic acids that can be used include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

(Colorant)

A known pigment or dye that matches the color of the toner can be used as the colorant. In order to achieve high quality image formation using the toner, the amount of the colorant is preferably at least 1.00 part by mass and no greater than 20.0 parts by mass relative to 100 parts by mass of the binder resin.

The toner cores may contain a black colorant. Carbon black can for example be used as a black colorant. Alternatively, a colorant that is adjusted to a black color using a yellow colorant, a magenta colorant, and a cyan colorant can be used as a black colorant.

The toner cores may include a non-black colorant such as a yellow colorant, a magenta colorant, or a cyan colorant.

The yellow colorant that can be used is for example at least one compound selected from the group consisting of condensed azo compounds, isoindolinone compounds, anthraquinone compounds, azo metal complexes, methine compounds, and arylamide compounds. Examples of yellow colorants that can be used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S. Hansa Yellow G, and C.I. Vat Yellow.

The magenta colorant that can be used is for example at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples of magenta colorants that can be used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206. 220, 221, or 254).

The cyan colorant that can be used is for example at least one compound selected from the group consisting of copper phthalocyanine compounds, anthraquinone compounds, and basic dye lake compounds. Examples of cyan colorants that can be used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The releasing agent is for example used in order to improve fixability or offset resistance of the toner. In order to increase the anionic strength of the toner cores, the toner cores are preferably prepared using an anionic wax. In order to improve fixability or offset resistance of the toner, the amount of the releasing agent is preferably at least 1.00 part by mass and no greater than 30.0 parts by mass relative to 100 parts by mass of the binder resin.

Examples of releasing agents that can be used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a fatty acid ester is partially or fully deoxidized such as deoxidized carnauba wax. One releasing agent may be used independently, or two or more releasing agents may be used in combination.

In order to improve compatibility between the binder resin and the releasing agent, a compatibilizer may be added to the toner cores.

(Charge Control Agent)

The charge control agent is for example used in order to improve charge stability or a charge rise characteristic of the toner. The charge rise characteristic of the toner is an indicator as to whether the toner can be charged to a specific charge level in a short period of time.

The anionic strength of the toner cores can be increased through the toner cores containing a negatively chargeable charge control agent. The cationic strength of the toner cores can be increased through the toner cores containing a positively chargeable charge control agent. However, when it is ensured that the toner has sufficient chargeability, the toner cores do not need to contain a charge control agent.

(Magnetic Powder)

Examples of materials of the magnetic powder that can be used include ferromagnetic metals, alloys of the ferromagnetic metals, ferromagnetic metal oxides, and materials subjected to ferromagnetization. Examples of ferromagnetic metals that can be used include iron, cobalt, and nickel. Examples of ferromagnetic metal oxides that can be used include ferrite, magnetite, and chromiun dioxide. Examples of ferromagnetization include thermal treatment. One magnetic powder may be used independently, or two or more magnetic powders may be used in combination.

The magnetic powder is preferably subjected to surface treatment in order to inhibit elution of metal ions (for example, iron ions) from the magnetic powder. In a situation in which the shell layers are formed on the surfaces of the toner cores under acidic conditions, elution of metal ions to the surfaces of the toner cores causes the toner cores to adhere to one another more readily. It is thought that inhibiting elution of metal ions from the magnetic powder thereby inhibits the toner cores from adhering to one another.

<Shell Layer>

Preferably, the shell layers contain a thermoplastic resin. Examples of thermoplastic resins that can be contained in the shell layers include the thermoplastic resins listed in the section of (Binder Resin) under <Toner Core>. Preferably, the shell layers contain a copolymer of at least one styrene-based monomer and at least one acrylic acid-based monomer. Thus, charge stability of the toner can be further improved. Examples of styrene-based monomers that can be used include styrene. Examples of acrylic acid-based monomers that can be used include an acrylic acid ester.

The shell layers may further contain a thermosetting resin. Examples of thermosetting resins that can be contained in the shell layers include aminoaldehyde resins, polyimide resins, and xylene-based resins. An aminoaldehyde resin is synthesized through polycondensation of an aldehyde and a compound having an amino group. Examples of aldehydes that can be used include formaldehyde. Examples of aminoaldehyde resins that can be used include melamine-based resins, urea-based resins, sulfonamide-based resins, glyoxal-based resins, guanamine-based resins, and aniline-based resins. Examples of polyimide resins that can be used include maleimide polymers and bismaleimide polymers.

[Examples of Materials and Properties of First External Additive Particles]

Inclusion of the first external additive particles in the toner particles produces an effect of improving fluidity of the toner particles and handleability of the toner. In order to obtain this effect effectively, the first external additive particles preferably have a number average particle diameter of at least 0.01 μm and no greater than 1 μm.

<First Silica Particles>

Preferably, the first silica particles have a number average particle diameter of no greater than 30 nm. As a result, the first external additive particles in a dispersed state easily adhere to the surfaces of the toner mother particles, and thus function as an external additive more effectively.

<First Positive Chargeability Imparting Agent>

Preferably, the first positive chargeability imparting agent is a material generally known as a positive chargeability imparting agent and contains nitrogen atoms in molecules thereof. Preferably, the first positive chargeability imparting agent is for example an aminosilane or a silazane. More specifically, the first positive chargeability imparting agent is preferably N-2-(aminoethyl)-3-aminopropylmethyldimethoxysilane, N-2-(aminoethyl)-3-aminopropyltrimethoxysilane, N-2-(aminoethyl)-3-aminopropyltriethoxysilane, 3-aminopropyltrimethoxysilane, 3-aminopropyltriethoxysilane, 3-triethoxysilyl-N-(1,3-dimethyl-butyliden)propylamine, N-phenyl-3-aminopropyltriethoxysilane, or a cyclic silazane.

<First Hydrophobing Agent>

Preferably, the first hydrophobing agent is a material generally known as a hydrophobing agent and contains hydrocarbon groups in molecules thereof. Preferably, the first hydrophobing agent is for example methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxvsilane, methyltriethoxysilane, dimethyldiethoxysilane, phenyltriethoxysilane, diphenyldiethoxysilane, isobutyltrimethoxysilane, decyltrimethoxysilane, hexamethyldisilazane (HMDS), N,O-(bistrimethylsilyl)acetamide, N,N-bis(trimethylsilyl)urea, tert-butyldimethylchlorosilane, vinyltrichlorosilane, vinyltrimethoxysilane, vinyltriethoxysilane, γ-methacryloxy-propyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, γ-chloropropyltrimethoxysilane, dimethyl silicone oil, alkyl-modified silicone oil, amino-modified silicone oil, carboxyl-modified silicone oil, epoxy-modified silicone oil, fluorine-modified silicone oil, alcohol-modified silicone oil, polyether-modified silicone oil, methylphenyl silicone oil, methylhydrogen silicone oil, mercapto-modified silicone oil, higher fatty acid-modified silicone oil, phenol-modified silicone oil, methacrylic acid-modified silicone oil, polyether-modified silicone oil, or methylstyryl-modified silicone oil.

[Examples of Properties of Second External Additive Particles]

Inclusion of the second external additive particles in the toner particles also produces an effect of improving fluidity of the toner particles and handleability of the toner. In order to obtain this effect effectively, the second external additive particles preferably have a number average particle diameter of at least 0.01 μm and no greater than 1 μm.

<Second Silica Particles>

Preferably, the second silica particles have a number average particle diameter of no greater than 30 nm. As a result, the second external additive particles in a dispersed state easily adhere to the surfaces of the toner mother particles, and thus function as an external additive more effectively.

According to the toner of the present disclosure, it is possible to prevent both replenishment fogging and low temperature and low humidity environment fogging in the case of image formation by the touchdown developing method. According to the toner produced by the production method of the present disclosure, it is possible to prevent both replenishment fogging and low temperature and low humidity environment fogging in the case of image formation by the touchdown developing method. According to the image forming apparatus of the present disclosure, it is possible to prevent both replenishment fogging and low temperature and low humidity environment fogging in the case of image formation by the touchdown developing method. According to the image formation method of the present disclosure, it is possible to prevent both replenishment fogging and low temperature and low humidity environment fogging in the case of image formation by the touchdown developing method.

EXAMPLES

The following describes Examples of the present disclosure. Table 1 shows toners T-1 to T-14 according to Examples and Comparative Examples. In Table 1, "HMDS" represents hexamethyldisilazane. External additive particles A-1 are positively chargeable silica particles ("AEROSIL (registered Japanese trademark) RA-200H", product of Nippon Aerosil Co., Ltd.). External additive particles A-2 are positively chargeable silica particles ("CAB-O-SIL (registered Japanese trademark) TS-820F", product of Cabot Corporation). Table 1 shows surface treatment agents used for respective external additive particles A-1 and A-2. "Silane" shown as "Surface treatment agent" of "External additive particles B" is an alkylalkoxysilane. The number in parentheses following "Silane" represents the carbon number of the alkyl group in the alkylalkoxysilane. Table 2 shows surface treatment agents used for respective external additive particles B-1 to B-8. The external additive particles B-1 to B-8 have negative chargeability.

TABLE 1

| Toner | | | | |
|---|---|---|---|---|
| | External additive | | | |
| | External additive particles A | | External additive particles B | |
| Type | Type | Surface treatment agent | Type | Surface treatment agent |
| T-1 | A-1 | Aminosilane and HMDS | B-1 | Silane (8) |
| T-2 | | | | |
| T-3 | | | | |
| T-4 | | | | |
| T-5 | | | | |
| T-6 | | | B-2 | Silane (10) |
| T-7 | | | B-3 | Silane (12) |
| T-8 | | | B-4 | Silane (16) |
| T-9 | A-2 | Cyclic silazane and HMDS | B-1 | Silane (8) |
| T-10 | A-1 | Aminosilane and HMDS | B-5 | Silane (3) |
| T-11 | | | B-6 | Silane (6) |
| T-12 | | | A-2 | Cyclic silazane and HMDS |
| T-13 | | | B-7 | Silane (3) and Silane (8) |
| T-14 | | | B-8 | Silane (18) |

TABLE 2

| Surface treatment agent of external additive particles B | | |
|---|---|---|
| Type | Material | Chemical formula |
| Silane (3) | n-propyltrimethoxysilane | $CH_3(CH_2)_2Si(OCH_3)_3$ |
| Silane (6) | n-hexyltrimethoxysilane | $CH_3(CH_2)_5Si(OCH_3)_3$ |
| Silane (8) | n-octyltriethoxysilane | $CH_3(CH_2)_7Si(OC_2H_5)_3$ |
| Silane (10) | n-decyltrimethoxysilane | $CH_3(CH_2)_9Si(OCH_3)_3$ |
| Silane (12) | n-dodecyltrimethoxysilane | $CH_3(CH_2)_{11}Si(OCH_3)_3$ |
| Silane (16) | n-hexadecyltrimethoxysilane | $CH_3(CH_2)_{15}Si(OCH_3)_3$ |
| Silane (18) | n-octadecyltriethoxysilane | $CH_3(CH_2)_{17}Si(OC_2H_5)_3$ |

The following first describes a preparation method of the external additive particles B-1 to B-8. Next, a production method, evaluation methods, and evaluation results of the toners T-1 to T-14 are described in the stated order. In evaluations in which errors might occur, an evaluation value was calculated by calculating the arithmetic mean of an appropriate number of measured values in order to ensure that any errors were sufficiently small.

[Preparation Method of External Additive Particles B]

<Preparation Method of External Additive Particles B-1>

Into a four-necked flask (capacity: 2 L) equipped with a stirrer, a thermometer, and a cooler, 30.0 parts by mass of hydrophilic fumed silica particles ("AEROSIL 200", product of Nippon Aerosil Co., Ltd.) were added. Nitrogen was introduced into the flask, and thus the flask was purged with nitrogen. Water in an amount necessary for hydrolysis of n-octyltriethoxysilane (surface treatment agent, "KBE-3083", product of Shin-Etsu Chemical Co., Ltd., Silane (8) in Table 2) was sprayed into the flask while the flask content was stirred. Thereafter, 7.5 parts by mass of n-octyltriethoxysilane was sprayed into the flask, and the internal temperature of the flask was raised up to 250° C. The internal temperature of the flask was maintained at 250° C. for 180 minutes. Hydroxyl groups present in the surfaces of the silica particles reacted with a hydrolysate of the n-octyltriethoxysilane while the internal temperature of the flask was maintained at 250° C. Thereafter, the cooler was detached from the flask. Nitrogen and alcohol were removed from the flask while the internal temperature of the flask was maintained at 250° C. Through the above, a powder including a plurality of external additive particles B-1 was obtained.

<Preparation Method of External Additive Particles B-2>

The external additive particles B-2 were prepared according to the same method as the preparation method of the external additive particles B-1 in all aspects other than that n-decyltrimethoxysilane ("KBM-3103C", product of Shin-Etsu Chemical Co., Ltd., Silane (10) in Table 2) was used as the surface treatment agent.

<Preparation Method of External Additive Particles B-3>

The external additive particles B-3 were prepared according to the same method as the preparation method of the external additive particles B-1 in all aspects other than that n-dodecyltrimethoxysilane ("D3383", product of Tokyo Chemical Industry Co., Ltd., Silane (12) in Table 2) was used as the surface treatment agent.

<Preparation Method of External Additive Particles B-4>

The external additive particles B-4 were prepared according to the same method as the preparation method of the external additive particles B-1 in all aspects other than that n-hexadecyltrimethoxysilane ("H1376", product of Tokyo Chemical Industry Co., Ltd., Silane (16) in Table 2) was used as the surface treatment agent.

<Preparation Method of External Additive Particles B-5>

The external additive particles B-5 were prepared according to the same method as the preparation method of the external additive particles B-1 in all aspects other than that n-propyltrimethoxysilane ("KBM-3033", product of Shin-Etsu Chemical Co., Ltd., Silane (3) in Table 2) was used as the surface treatment agent.

<Preparation Method of External Additive Particles B-6>

The external additive particles B-6 were prepared according to the same method as the preparation method of the external additive particles B-1 in all aspects other than that n-hexyltrimethoxysilane ("KBM-3063", product of Shin-Etsu Chemical Co., Ltd., Silane (6) in Table 2) was used as the surface treatment agent.

<Preparation Method of External Additive Particles B-7>

The external additive particles B-7 were prepared according to the same method as the preparation method of the external additive particles B-1 in all aspects other than that n-propyltrimethoxysilane ("KBM-3033", product of Shin-Etsu Chemical Co., Ltd., Silane (3) in Table 2) and n-octyltriethoxysilane ("KBE-3083", product of Shin-Etsu Chemical Co., Ltd., Silane (8) in Table 2) were used as the surface treatment agent. Note that a mass ratio between the sprayed n-propyltrimethoxysilane and n-octyltriethoxysilane was 1:1.

<Preparation Method of External Additive Particles B-8>

The external additive particles B-8 were prepared according to the same method as the preparation method of the external additive particles B-1 in all aspects other than that n-octadecyltriethoxysilane ("O0165", product of Tokyo Chemical Industry Co., Ltd., Silane (18) in Table 2) was used as the surface treatment agent.

[Toner Production Method]

<Production Method of Toner T-1>

First, toner mother particles were prepared. More specifically, 86.0 parts by mass of a polyester resin ("TUFTONE (registered Japanese trademark) NE-410", product of Kao Corporation), 3.00 parts by mass of carbon black ("REGAL (registered Japanese trademark) 330R", product of Cabot Corporation), 2.00 parts by mass of a charge control agent (quaternary ammonium salt: "BONTRON (registered Japanese trademark) P-51", product of ORIENT CHEMICAL INDUSTRIES, Co., Ltd.), 4.00 parts by mass of a polymer positively chargeable charge control agent ("ACRYBASE (registered Japanese trademark) FCA-201-PS", product of FUJIKURA KASEI CO., LTD.), and 5.00 parts by mass of polypropylene wax ("VISCOL (registered Japanese trademark) 660P", product of Sanyo Chemical Industries. Ltd.) were loaded into an FM mixer (product of Nippon Coke & Engineering Co., Ltd.) and mixed at a rotational speed of 2,400 rpm for 180 seconds.

The resultant mixture was melt-kneaded using a two-axis extruder ("PCM-30", product of Ikegai Corp.) under conditions of a material feeding speed of 5 kg/hour, a shaft rotational speed of 150 rpm, and a temperature (cylinder temperature) of 150° C. The resultant melt-kneaded product was cooled, and then coarsely pulverized using a pulverizer ("Rotoplex Mill 8/16", product of former TOA MACHINERY MFG. CO., LTD.). The resultant coarsely pulverized product was finely pulverized using a pulverizer ("Turbo Mill RS", product of FREUND-TURBO CORPORATION). The resultant finely pulverized product was classified using a classifier ("Elbow Jet EJ-LABO", product of Nittetsu Mining Co., Ltd.). As a result, toner mother particles having a volume median diameter ($D_{50}$) of 6.5 μm were obtained.

Next, external additive addition was performed. More specifically, 100.00 parts by mass of the toner mother particles, 1.50 parts by mass of the external additive particles A-1, 0.40 parts by mass of the external additive particles B-1, and 1.00 part by mass of titanium oxide particles ("MT-500B", product of TAYCA CORPORATION) were loaded into an FM mixer ("FM-10B", product of Nippon Coke & Engineering Co., Ltd., capacity: 10 L) and mixed at a rotational speed of 3,500 rpm for 5 minutes. Through the above, the toner T-1 including a number of toner particles was obtained.

<Production Method of Toners T-2 to T-5>

The toners T-2 to T-5 were produced according to the same method as the production method of the toner T-1 in all aspects other than that amounts of the external additive particles A-1 and the external additive particles B-1 that were blended were changed to the values shown in Table 3.

In Table 3, the amount of the external additive particles A-1 means the amount of the external additive particles A-1 blended relative to 100.00 parts by mass of the toner mother particles. The amount of the external additive particles B-1 means the amount of the external additive particles B-1 blended relative to 100.00 parts by mass of the toner mother particles. The blending ratio means a ratio of the amount of the external additive particles B-1 to the amount of the external additive particles A-1.

TABLE 3

| Toner | | | |
|---|---|---|---|
| | Amount (parts by mass) | | |
| Type | External additive particles A-1 | External additive particles B-1 | Blending ratio |
| T-1 | 1.50 | 0.40 | 0.267 |
| T-2 | 1.70 | 0.60 | 0.353 |
| T-3 | 1.70 | 0.20 | 0.118 |
| T-4 | 1.20 | 0.60 | 0.500 |
| T-5 | 1.20 | 0.20 | 0.167 |

<Production Method of Toners T-6 to T-14>

The toners T-6 to T-14 were produced according to the same method as the production method of the toner T-1 in all aspects other than that at least one of the material of the external additive particles A and the material of the external additive particles B was changed as shown in Table 1.

[Toner Evaluation Method]

The toners T-1 to T-14 were evaluated according to methods described below. In each of the evaluations described below, two-component developers produced as described below were used as evaluation targets. That is, with respect to each of the toners T-1 to T-14, the toner and a carrier (carrier for "TASKalfa 5550ci", product of KYOCERA Document Solutions Inc.) were loaded into a ball mill so as to give a toner content of 10% by mass and were mixed for 30 minutes. Thus, each evaluation target was obtained. In each evaluation target, the toner was positively charged by friction against the carrier.

A color multifunction peripheral ("TASKalfa 500ci", product of KYOCERA Document Solutions Inc.) was used as an evaluation apparatus. The evaluation apparatus adopted the touchdown developing method. The evaluation apparatus included an amorphous silicon drum as a photosensitive drum. A sleeve coat layer of a development roller of the evaluation apparatus was formed of a urethane resin. A development section of the evaluation apparatus contained the evaluation target (unused). A toner container of the evaluation apparatus contained a toner for replenishment use (unused). The toner for replenishment use was the same as the toner included in the evaluation target.

<Replenishment Fogging Evaluation>

Under environmental conditions of a temperature of 20° C. and a relative humidity of 50% (in a normal temperature and normal humidity environment), a first printing durability test in which printing was performed on 10,000 successive sheets of A4 size plain paper at a coverage of 5.0%, a second printing durability test in which printing was performed on 3,000 successive sheets of A4 size plain paper at a coverage of 2.0%, and a third printing durability test in which printing was performed on 1,000 successive sheets of A4 size plain paper at a coverage of 20% were carried out in the stated order. In the third printing durability test, a reflection density of a blank portion (background portion) of each post-printing sheet was measured using a reflectance densitometer ("RD914", product of X-Rite Inc.) to determine a maximum value of a first fogging density (FD) (a greatest first fogging density of fogging densities of the 1,000 sheets). The first fogging density (FD) was equivalent to a value obtained by subtracting the reflection density of base paper (a sheet not printed on) from the reflection density of the blank portion of the post-printing sheet.

The evaluation standard based on the replenishment fogging was as follows. Table 4 shows evaluation results.

Good: The maximum value of the first fogging density (FD) was no greater than 0.0100.

Poor: The maximum value of the first fogging density (FD) was greater than 0.0100.

<Evaluation of Low Temperature and Low Humidity Environment Fogging>

Under environmental conditions of a temperature of 10° C. and a relative humidity of 10% (in a low temperature and low humidity environment), the evaluation apparatus was left to stand for 24 hours, and then a fourth printing durability test in which printing was performed on 1,000 successive sheets at a coverage of 5.0% was carried out. Subsequently, under the same environmental conditions, the evaluation apparatus was left to stand for 24 hours, and then a fifth printing durability test in which printing was performed on 50 successive sheets at a coverage of 5.0% was carried out. More specifically, the evaluation apparatus was left to stand for 24 hours with the development section thereof containing the evaluation target (unused) and the toner container thereof containing the toner for replenishment use (unused). In the fifth printing durability test, a reflection density of a blank portion (background portion) of each post-printing sheet was measured using a reflectance densitometer ("RD914", product of X-Rite Inc.) to determine a maximum value of a second fogging density (FD) (a greatest second fogging density of fogging densities of the 50 sheets).

The evaluation standard based on the low temperature and low humidity environment fogging was as follows. Table 4 shows evaluation results.

Good: The maximum value of the second fogging density (FD) was no greater than 0.010.

Poor: The maximum value of the second fogging density (FD) was greater than 0.010.

TABLE 4

| | | Replenishment fogging | | Low temperature and low humidity environment fogging | |
|---|---|---|---|---|---|
| | Toner | Measurement | Evaluation | Measurement | Evaluation |
| Example 1 | T-1 | 0.002 | Good | 0.004 | Good |
| Example 2 | T-2 | 0.004 | Good | 0.006 | Good |
| Example 3 | T-3 | 0.008 | Good | 0.002 | Good |
| Example 4 | T-4 | 0.003 | Good | 0.007 | Good |
| Example 5 | T-5 | 0.002 | Good | 0.002 | Good |
| Example 6 | T-6 | 0.004 | Good | 0.003 | Good |
| Example 7 | T-7 | 0.006 | Good | 0.007 | Good |
| Example 8 | T-8 | 0.008 | Good | 0.004 | Good |
| Example 9 | T-9 | 0.004 | Good | 0.003 | Good |
| Comparative Example 1 | T-10 | 0.003 | Good | 0.023 | Poor |
| Comparative Example 2 | T-11 | 0.005 | Good | 0.018 | Poor |
| Comparative Example 3 | T-12 | 0.019 | Poor | 0.002 | Good |
| Comparative Example 4 | T-13 | 0.003 | Good | 0.014 | Poor |
| Comparative Example 5 | T-14 | 0.017 | Poor | 0.007 | Good |

In Table 4, "Measurement" of "Replenishment fogging" shows the maximum value of the first fogging density (FD). Likewise, "Measurement" of "Low temperature and low humidity environment fogging" shows the maximum value of the second fogging density (FD).

The toners T-1 to T-9 (toners according to Examples 1 to 9) each had positive chargeability. The toners T-1 to T-9 each included a plurality of toner particles. The toner particles each included a toner mother particle and external additive particles adhering to a surface of the toner mother particle. The external additive particles included the first external additive particles and the second external additive particles. The first external additive particles had positive chargeability and were each the first silica particle having a surface treated with the first positive chargeability imparting agent and the first hydrophobing agent. The second external additive particles had negative chargeability and were each the second silica particle having a surface treated only with the silane compound. The silane compound was at least one alkylalkoxysilane represented by formula (1) shown above.

As indicated in Table 4, the toners T-1 to T-9 were each able to prevent occurrence of replenishment fogging and prevent occurrence of low temperature and low humidity environment fogging.

Each of the toners T-10 and T-11 (toners according to Comparative Examples 1 and 2) resulted in occurrence of low temperature and low humidity environment fogging. It is thought that such a result was obtained because the alkyl group in the surface treatment agent of the external additive particles B had a carbon number of less than 8.

The toner T-12 (toner according to Comparative Example 3) resulted in occurrence of replenishment fogging. It is thought that such a result was obtained for the following reason. The external additive particles A-2 were positively chargeable external additive particles. Therefore, the toner T-12 did not produce an effect of inhibiting replenishment fogging, which is produced when negatively chargeable external additive particles are added to the toner.

The toner T-13 (toner according to Comparative Example 4) resulted in occurrence of low temperature and low humidity environment fogging. It is thought that such a result was obtained because the alkyl group in the surface treatment agent of the external additive particles B included the alkylalkoxysilane containing an alkyl group having a carbon number of less than 8.

The toner T-14 (toner according to Comparative Example 5) resulted in occurrence of replenishment fogging. It is thought that such a result was obtained because the alkyl group in the surface treatment agent of the external additive particles B had a carbon number of greater than 16.

It was confirmed that replenishment fogging and low temperature and low humidity environment fogging had occurred in the case where the external additive particles B treated with a surface treatment agent including a long-chain alkylalkoxysilane were used.

What is claimed is:

1. An electrostatic latent image developing toner comprising a plurality of toner particles, wherein the electrostatic latent image developing toner has positive chargeability, the toner particles each include a toner mother particle and external additive particles adhering to a surface of the toner mother particle, the external additive particles include a plurality of first external additive particles and a plurality of second external additive particles, the first external additive particles have positive chargeability and are each a first silica particle having a surface treated with a positive chargeability imparting agent and a hydrophobing agent, the second external additive particles have negative chargeability and are each a second silica particle having a surface treated only with a silane compound, and the silane compound is at least one alkylalkoxysilane represented by formula (1) shown below,

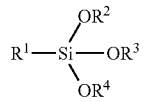

(1)

where in formula (1), $R^1$ represents an alkyl group having a carbon number of at least 8 and no greater than 16, and $R^2$, $R^3$, and $R^4$ each represent, independently of one another, an optionally substituted hydrocarbon group.

2. The electrostatic latent image developing toner according to claim 1, wherein the second external additive particles are modified silica particles that are each the second silica particle having a surface chemically-modified only with a modifying group of a structure represented by formula (2) shown below,

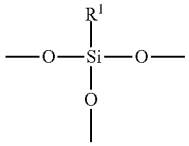

(2)

where in formula (2), $R^1$ represents an alkyl group having a carbon number of at least 8 and no greater than 16, and one of three available bonds of oxygen atoms is bonded to a silicon atom forming silica contained in the second silica particles, and remaining two of the three available bonds are each independently bonded to an optionally substituted hydrocarbon group for a termination.

3. The electrostatic latent image developing toner according to claim 1, wherein an amount of the first external additive particles is at least 1.20 parts by mass and no greater than 2.00 parts by mass relative to 100.00 parts by mass of the toner mother particles, an amount of the second external additive particles is at least 0.20 parts by mass and no greater than 0.60 parts by mass relative to 100.00 parts by mass of the toner mother particles, and a ratio of the amount of the second external additive particles to the amount of the first external additive particles is at least 0.100 and no greater than 0.400.

4. The electrostatic latent image developing toner according to claim 1, wherein in formula (1), $R^2$, $R^3$, and $R^4$ each represent, independently of one another, a methyl group or an ethyl group.

5. The electrostatic latent image developing toner according to claim 1, wherein the first external additive particles are modified silica particles that are each the first silica particle having a surface chemically-modified with a positively chargeable functional group and a hydrophobic group, the positively chargeable functional group contains a nitrogen atom, and the hydrophobic group contains a hydrocarbon group.

6. The electrostatic latent image developing toner according to claim 1, wherein the electrostatic latent image developing toner is used in image formation by touchdown development.

7. An image forming apparatus for forming an image using a developer, comprising:

an image bearing member configured to bear an electrostatic latent image on a surface thereof; and a development section configured to develop the electrostatic latent image into a toner image, wherein the developer includes:

the electrostatic latent image developing toner according to claim 1; and electrostatic latent image developing carrier configured to positively charge the electrostatic latent image developing toner by friction, the development section includes:

a developer bearing member configured to bear the developer on a surface thereof; and a toner bearing member configured to receive the electrostatic latent image developing toner from the developer bearing member and bear the electrostatic latent image developing toner on a surface thereof, the developer bearing member and the toner bearing member rotate while the developer on the surface of the developer bearing member is in contact with the toner bearing member, and the toner bearing member and the image bearing member are disposed such that the electrostatic latent image developing toner on the surface of the toner bearing member detaches therefrom and lands on the electrostatic latent image to develop the electrostatic latent image into the toner image.

8. The image forming apparatus according to claim 7, wherein the toner bearing member includes a shaft and a sleeve rotatable about the shaft, the sleeve includes a sleeve substrate and a sleeve coat layer disposed over the sleeve substrate, and the sleeve coat layer contains a urethane resin.

9. A method for forming an image using a developer, the method comprising:

causing the developer to be carried on a surface of a developer bearing member, the developer including the electrostatic latent image developing toner according to claim 1 and an electrostatic latent image developing carrier for positively charging the electrostatic latent image developing toner by friction;

forming a toner layer including the electrostatic latent image developing toner on a surface of a toner bearing member located opposite to the developer bearing member;

forming an electrostatic latent image on a surface of an image bearing member located opposite to the toner bearing member; and causing the electrostatic latent image developing toner to detach from the toner layer and land on the electrostatic latent image to develop the electrostatic latent image into a toner image, wherein in the forming the toner layer on the surface of the toner bearing member, the electrostatic latent image developing toner is caused to move from the surface of the developer bearing member to the surface of the toner bearing member through the developer on the surface of the developer bearing member rubbing against the surface of the toner bearing member.

* * * * *